US005511660A

United States Patent [19]

Yamada et al.

[11] Patent Number: 5,511,660

[45] Date of Patent: Apr. 30, 1996

[54] DEVICE FOR SECURING GOLF CLUBS

[76] Inventors: Kikuo Yamada; Eigou Yamada, both of 3-28-3, Sakuragaoka, Seika-cho, Souraku-Gun, Kyoto, Japan

[21] Appl. No.: 226,900

[22] Filed: Apr. 13, 1994

[51] Int. Cl.[6] ..... A63B 55/00

[52] U.S. Cl. ..... 206/315.6; 206/315.3

[58] Field of Search ..... 206/315.3, 315.6, 206/315.2, 315.4; 273/32 F

[56] References Cited

U.S. PATENT DOCUMENTS

| | | | |
|---|---|---|---|
| 1,849,610 | 3/1932 | Boyce | 206/315.6 |
| 2,128,546 | 8/1938 | Venmore | 206/315.6 X |
| 2,436,687 | 2/1948 | Corbett | 206/315.6 |
| 2,752,973 | 7/1956 | Stamp | 206/315.6 |
| 3,667,078 | 6/1972 | Distasio | 206/315.6 X |
| 4,368,768 | 1/1983 | Cunko | 206/315.4 X |
| 4,860,889 | 8/1989 | Lemieux et al. | 206/315.6 |
| 5,345,987 | 9/1994 | Hagar | 206/315.4 X |
| 5,383,555 | 1/1995 | Weinmeier | 206/315.3 X |

FOREIGN PATENT DOCUMENTS

| | | | |
|---|---|---|---|
| 58-177676 | 10/1983 | Japan . | |
| 60-15367 | 2/1985 | Japan . | |
| 60-138571 | 9/1985 | Japan . | |
| 62-133666 | 8/1987 | Japan . | |
| 385063 | 8/1991 | Japan . | |
| 414168 | 8/1934 | United Kingdom | 206/315.5 |

OTHER PUBLICATIONS

Drawing of a device currently sold in Japan. No date available.

*Primary Examiner*—Sue A. Weaver

*Attorney, Agent, or Firm*—Christopher R. Pastel; Thomas R. Morrison

[57] ABSTRACT

A device for securing golf clubs in a fixed position in a golf bag consists of a resilient clip on a post which is connected to a support. The support has a bracket to fit the opening of a golf bag. The shaft of the golf club is inserted into the golf bag, and the head of the golf club is pressed onto the clip from above. The resilient clip is configured for receiving the golf club head. The clip can be adjusted for different angles so as to easily fit different irons. The support may incorporate means for adjusting the size of the support to fit any golf bag.

8 Claims, 2 Drawing Sheets

DEVICE FOR SECURING GOLF CLUBS

BACKGROUND OF THE INVENTION

The present invention relates to a device for securing golf clubs in a golf bag so that golf clubs can be stored in the bag in a manner inhibiting club movement thereby preventing noise and damage to the clubs while carrying or moving the golf bag.

Conventional golf bags commonly use a dividing board or a tube placed inside the bag. With such an arrangement, the clubs are not held securely in place, and clubs rattle and cause noise when being lifted, carried, or put down. Damage to the clubs also occurs.

To provide against club damage, it is known in the art to place a protective covering over each club head to protect the club and muffle noise. However, it is then difficult to distinguish between clubs without removing the covering. In addition, the golf club shafts still collide while in the bag.

OBJECTS AND SUMMARY OF THE INVENTION

Accordingly, it is an object of the present invention to reduce or eliminate noise caused by golf clubs rattling and banging each other when carried in a golf bag.

It is a further object of the invention to eliminate damage caused by the clubs banging against each other when carried in the golf bag.

It is a still further object of the invention to eliminate the confusion which occurs when a club is selected if using a protective covering by eliminating the need for such a covering.

In order to achieve these objects, the present invention provides a device which secures each golf club in a golf bag. The device consists of a resilient clip on a post which is connected to a support which attaches to the golf bag. The resilient clip is configured for receiving a golf club head. The shaft of the golf club is inserted into the golf bag, and the head of the golf club is pressed onto the clip from above.

Briefly stated, the present invention provides a device for securing golf clubs in a fixed position within a golf club bag, with the device including a support receivable within the golf club bag and means for attaching the support to the golf club bag. There is at least one post having means for connecting to the support, as well as means for securing the golf club and means for fastening the securing means to the post.

According to an embodiment of the invention, the means for securing includes plastic, rubber, or other flexible means for holding the head of the golf club. The flexible means for holding may consist of a resilient clip which can be adjusted for different angles so as to easily fit different irons.

According to another embodiment of the invention, the means for fastening the clip to the post may include a plurality of notches arranged equidistant and in series parallel to the base edge of the clip and teeth projecting from the post corresponding to the teeth.

According to still another embodiment, the means for attaching the support to the golf bag consists of several brackets on the support which fit over the golf bag at the opening. The support may also have a slidable portion so that the support can be adjusted to fit any size golf club bag.

DETAILED DESCRIPTION OF THE PREFERRED EMBODIMENTS

Figure 1:
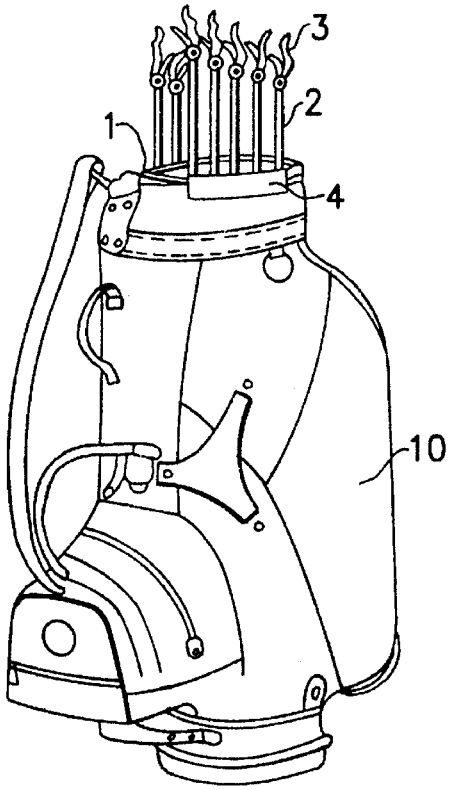
FIG. 1 is a perspective view of a golf club bag embodying the device of the present invention.

Referring to FIG. 1, a golf bag 10, having an opening at an upper end, is configured to receive a support 1 which fits over the upper end of the golf bag 10 using a bracket 4. Other conventional means for attaching the support 1 to the golf bag 10 may be used. A post 2 is connected to the support 1 of the golf bag 10 using screws, adhesive, or other conventional means. A resilient clip 3 is connected to an end of the post 2 either in a fixed manner or in a rotably attached manner. The clip 3 is made from plastic, rubber, or the like to prevent damage to a metal or wooden head of a golf club, and can be shaped to fit the head. The height of the posts 2 above the bag opening may be staggered to achieve slightly greater separation between club heads.

Figure 2A:
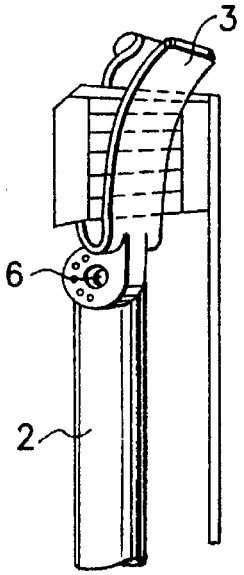
FIG. 2*a* is a perspective view of the post and clip.
Figure 2B:
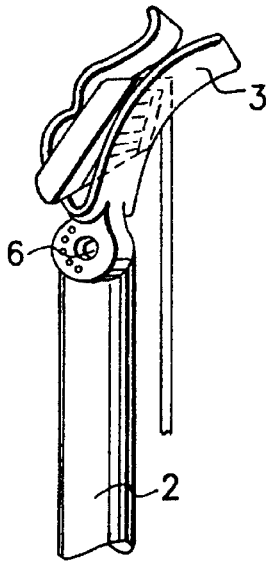
FIG. 2*b* is a perspective view of the post and clip adjusted to receive an angled iron.
Figure 3A:
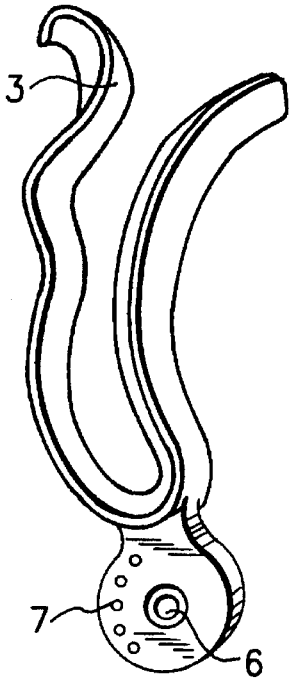
FIG. 3*a* is a perspective side view of the clip of the preferred embodiment.
Figure 3B:
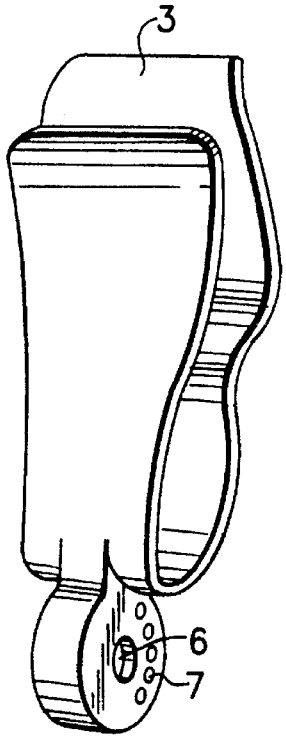
FIG. 3*b* is a perspective front view of the clip of the preferred embodiment.

Referring to FIGS. 2 and 3, a golf club iron is pressed into clip 3 from above, and is held in place by the spring action of the resilient clip. The clip 3 may be rotably attached to the post 2 so that the angle of clip with respect to the post can be changed to allow for differences in angles in the heads of golf club irons. A bolt, screw, or other fastener is inserted through the opening 6 in the base of clip 3 for rotably attaching the clip to the post. Notches 7 corresponding to projecting teeth (not shown) on the post increase the strength of the rotable attachment of the clip to the post and prevent unwanted slippage. The notches are arranged equidistant and in series parallel to the base edge of the clip 3.

Figure 4:
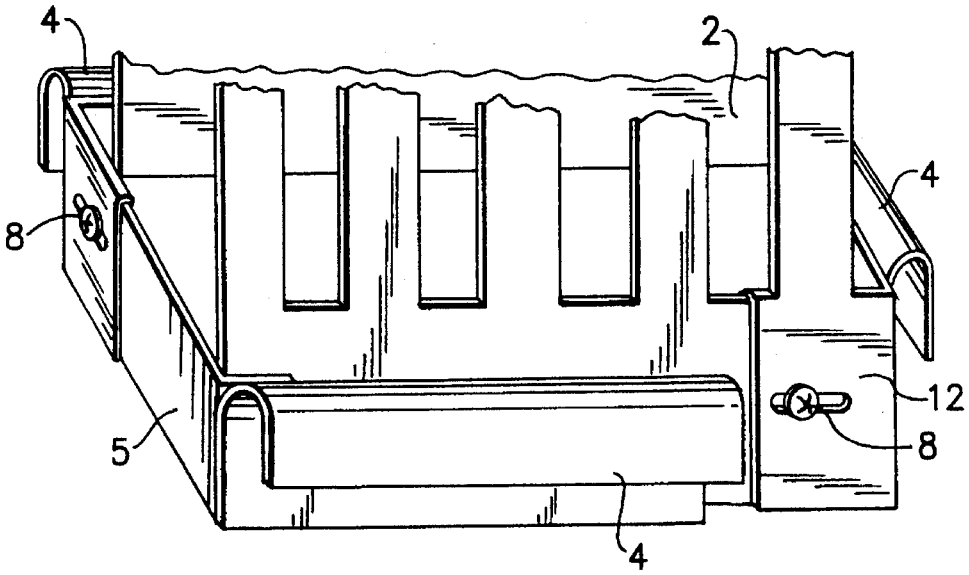
FIG. 4 is a fragmented perspective view of the support in an embodiment of the invention.

Referring to FIG. 4, an embodiment of this invention includes slidable portion 12 which can be adjusted to fit any size bag by using sliding adjustment screw 8. Brackets 4 may be on two, three, or all four sides of support 2 to provide stability to the device when attached to golf bag 10. The support 1 and post 2 can be formed as an integral unit or may be mounted using conventional connection means.

By having the clubs so fixed, it is possible to eliminate damage to clubs caused by the clubs hitting against each other while the golf bag is being carried, and it is also possible to eliminate noise. Furthermore, by keeping the clubs in an orderly fashion, it is possible to select a desired club immediately.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for securing golf clubs in a fixed position within a golf club bag, said device comprising:

a support receivable within said golf club bag and including means for attaching said support to said golf club bag;

said support including a fixed portion and a slidable portion;

means for adjusting said slidable portion whereby said support can be adjusted to fit any size golf club bag;

at least one post having means for connecting to said support;

means for securing a golf club;

means for fastening said means for securing to said at least one post;

said means for fastening including a plurality of teeth projecting from said post and a plurality of notches on said securing means corresponding to said teeth.

2. A device according to claim 1, wherein said means for securing comprises a resilient clip; and said clip being made from a material selected from a group consisting of one of plastic and rubber.

3. A device according to claim 1, wherein said means for attaching comprises a plurality of brackets on said support.

4. A device for securing golf clubs in a fixed position within a golf club bag, said device comprising:

a support receivable within said golf club bag and including means for attaching said support to said golf club bag;

at least one post integrally formed with said support;

means for securing a golf club;

means for fastening said means for securing to said at least one post; and said means for fastening including a plurality of teeth projecting from said post and a plurality of notches on said securing means corresponding to said teeth.

5. A device according to claim 4, wherein said means for securing consists of a resilient clip.

6. A device according to claim 4, wherein said means for attaching comprises a plurality of brackets on said support.

7. A device according to claim 4, wherein said support further comprises means for adjusting a slidable portion whereby said support can be adjusted to fit any size golf club bag.

8. A device for securing golf clubs in a fixed position within a golf club bag, said device comprising:

a support receivable within said golf club bag;

said support having a plurality of brackets for attaching said support to said golf club bag;

said support including a fixed portion and a slidable portion;

means for adjusting said slidable portion whereby said support is adjusted to any size golf club bag;

at least one post integrally formed with said support;

means for securing a golf club made from a material selected from a group consisting of one of plastic and rubber;

means for fastening said means for securing to said at least one post; and said means for fastening includes a plurality of teeth projecting from said post and a plurality of notches on said securing means corresponding to said teeth.

* * * * *